US012727689B2

(12) United States Patent
Lee et al.

(10) Patent No.: US 12,727,689 B2
(45) Date of Patent: Sep. 8, 2026

(54) ROBOT AND METHOD OF CONTROLLING THE SAME

(71) Applicants: Hyundai Motor Company, Seoul (KR); Kia Corporation, Seoul (KR); Base and Power City Corp., Seoul (KR)

(72) Inventors: Donguk Lee, Seoul (KR); Sungsu Park, Seoul (KR)

(73) Assignees: Hyundai Motor Company, Seoul (KR); Kia Corporation, Seoul (KR); BASE AND POWER CITY CORP., Seoul (KR)

( * ) Notice: Subject to any disclaimer, the term of this patent is extended or adjusted under 35 U.S.C. 154(b) by 215 days.

(21) Appl. No.: 18/771,642

(22) Filed: Jul. 12, 2024

(65) Prior Publication Data

US 2025/0160545 A1 May 22, 2025

(30) Foreign Application Priority Data

Nov. 20, 2023 (KR) ..... 10-2023-0161401

(51) Int. Cl.
*A47G 5/02* (2006.01)
*B65H 75/44* (2006.01)

(52) U.S. Cl.
CPC ..... *A47G 5/02* (2013.01); *B65H 75/4402* (2013.01); *B65H 75/4484* (2013.01)

(58) Field of Classification Search
CPC .... A47G 5/02; B65H 5/4402; B65H 75/4484; E04B 2/74; E06B 9/08; E06B 9/86
USPC ..... 160/238
See application file for complete search history.

(56) References Cited

U.S. PATENT DOCUMENTS

| | | | | | |
|---|---|---|---|---|---|
| 193,573 | A * | 7/1877 | Tripp | A47G 5/02 | 160/122 |
| 5,875,597 | A * | 3/1999 | Gingrich | A47G 5/02 | 52/239 |
| 9,465,473 | B2 | 10/2016 | Lee et al. | | |
| 10,383,463 | B2 * | 8/2019 | Korn | A47G 5/02 | |
| 10,808,454 | B1 * | 10/2020 | Weix | A47G 5/02 | |
| 2007/0193705 | A1 * | 8/2007 | Hsu | E04H 12/2215 | 160/238 |
| 2013/0239856 | A1 | 9/2013 | Lee et al. | | |
| 2016/0079329 | A1 | 3/2016 | Lee et al. | | |
| 2018/0370756 | A1 * | 12/2018 | Wilcoxon | B65H 75/4486 | |
| 2021/0347601 | A1 * | 11/2021 | Shin | B65H 75/4449 | |

FOREIGN PATENT DOCUMENTS

| | | | | |
|---|---|---|---|---|
| JP | 3234609 | U | 10/2021 | |
| KR | 100825251 | B1 | 4/2008 | |
| KR | 20130005650 | U | 9/2013 | |
| KR | 20150024151 | A | 3/2015 | |
| KR | 20160032795 | A | 3/2016 | |
| KR | 20160059372 | A * | 5/2016 | G09F 9/301 |
| KR | 20160144596 | A | 12/2016 | |
| KR | 20200134477 | A | 12/2020 | |

* cited by examiner

*Primary Examiner* — Beth A Aubrey
(74) *Attorney, Agent, or Firm* — Slater Matsil, LLP

(57) ABSTRACT

A robot can include a partition wound about a partition rotation axis extending in a first direction, a plurality of body parts surrounding an accommodation space in which the partition is accommodated, and a roller part having a plurality of rollers rotatably mounted on at least some of the plurality of body parts.

20 Claims, 6 Drawing Sheets

ROBOT AND METHOD OF CONTROLLING THE SAME

CROSS-REFERENCE TO RELATED APPLICATIONS

This application claims the benefit of Korean Patent Application No. 10-2023-0161401, filed on Nov. 20, 2023, which application is hereby incorporated herein by reference.

TECHNICAL FIELD

The present disclosure relates to a robot and a method of controlling the same.

BACKGROUND

A partition is one way that is used to partition a space. This partition is generally manufactured to have a flat plate shape. In recent years, this partition is not only manufactured to have a certain shape but is also manufactured as a rollable partition that has rollable properties so that the partition may be unfolded or stored in an accommodation space as needed.

A robot provided with the rollable partition is provided with an accommodation body that includes an accommodation space in which the partition may be accommodated. In a robot according to the related art, the accommodation body is configured to be fixed to a specific area, and the rollable partition is extracted from the fixed accommodation body to partition a plurality of predetermined spaces.

Meanwhile, in the robot according to the related art, the plurality of predetermined spaces may be partitioned, but when positions of spaces that require partitioning change, a position of the accommodation body needs to be changed. That is, the robot according to the related art has a problem in that it is difficult to flexibly response to changes in the positions of the spaces that require the partitioning.

SUMMARY

An embodiment of the present disclosure can solve the above-mentioned problems occurring in the prior art while advantages achieved by the prior art are maintained intact.

An embodiment of the present disclosure can provide a robot that may flexibly respond to changes of positions of spaces that require partitioning.

Technical problems to be solved by an embodiment of the present disclosure are not limited to the aforementioned problems, and an embodiment of the present disclosure may solve other technical problems not mentioned herein, as can be understood from the following description by those skilled in the art to which the present disclosure pertains.

According to an embodiment of the present disclosure, a robot can include a partition wound about a partition rotation axis extending in a first direction, a plurality of body parts surrounding an accommodation space in which the partition is accommodated, and a roller part having a plurality of rollers rotatably mounted on at least some of the plurality of body parts, and the roller part includes a roller group that is a pair of rollers mounted to face each other in each of two adjacent body parts of the plurality of body parts, the roller part is provided in a guide state in which movement of a portion of the partition is guided in a second direction intersecting the first direction when the portion of the partition is positioned between the pair of rollers, and the roller part provided in the guide state extracts the partition from the accommodation space or retracts the partition into the accommodation space in the second direction through rotation of the pair of rollers.

Further, the robot may further include a vertical moving part provided to move in a vertical direction parallel to the first direction with respect to the body part, and the body part may include a first area on which the vertical moving part is movably mounted such that a portion of the vertical moving part is accommodated therein.

Further, when the vertical moving part moves to a lowermost side with respect to the body part, a height of an upper end of the vertical moving part may correspond to a height of an upper end of the body part in the vertical direction.

Further, the body part may include a second area that is connected to the first area and on which the roller is rotatably mounted such that a partial area of the roller is accommodated therein, and when a direction in which the first area faces the second area is referred to as a connection direction, the other partial area of the roller may protrude in the connection direction with respect to the second area.

Further, the plurality of second areas may include a $(2\text{-}1)^{th}$ area connected to one side of the first area, and a $(2\text{-}2)^{th}$ area connected to the other side of the first area, and a first connection direction that is a direction in which the one side of the first area faces the $(2\text{-}1)^{th}$ area, a second connection direction that is a direction in which the other side of the first area faces the $(2\text{-}2)^{th}$ area, and the first direction may intersect each other.

Further, the plurality of rollers may include a first roller mounted on the $(2\text{-}1)^{th}$ area, and a second roller mounted on the $(2\text{-}2)^{th}$ area, a portion of the first roller in a direction opposite to the first connection direction may be accommodated inside the $(2\text{-}1)^{th}$ area such that a side of the first roller in the first connection direction protrudes in the first connection direction with respect to the $(2\text{-}1)^{th}$ area, and a portion of the second roller in a direction opposite to the second connection direction may be accommodated inside the $(2\text{-}2)^{th}$ area such that a side of the second roller in the second connection direction protrudes in the second connection direction with respect to the $(2\text{-}2)^{th}$ area.

Further, the body part may further include a third area that defines a portion of an area forming the accommodation space and extends in the first direction, and the third area may include a recessed area provided to face the partition in a wound state and having a shape recessed in a direction toward the first area.

Further, a cross section of the recessed area along a direction perpendicular to the first direction may have a curvature of which a center of the curvature is positioned in the accommodation space.

Further, centers of curvature of the cross sections of the recessed areas provided in the plurality of body parts along a direction perpendicular to the first direction may correspond to each other.

Further, the plurality of body parts may include a first body part, a second body part, a third body part, and a fourth body part that are sequentially arranged in a clockwise direction or a counterclockwise direction perpendicular to the first direction, the roller group may include a first roller group that is a pair of rollers mounted to face each other in the first body part and the second body part, a second roller group that is a pair of rollers mounted to face each other in the second body part and the third body part, a third roller group that is a pair of rollers mounted to face each other in the third body part and the fourth body part, and a fourth roller group that is a pair of rollers mounted to face each other in the fourth body part and the first body part, and the first roller group, the second roller group, the third roller group, and the fourth roller group may be sequentially arranged in the clockwise direction or the counterclockwise direction.

Further, when one of horizontal directions perpendicular to the first direction is referred to as a first horizontal direction, and one of the horizontal directions perpendicular to the first horizontal direction is referred to as a second horizontal direction, the first body part and the third body part may be spaced apart from each other in the first horizontal direction with the partition interposed therebetween, and the second body part and the fourth body part may be spaced apart from each other in the second horizontal direction with the partition interposed therebetween.

Further, the robot may further include a robot driver that moves the plurality of body parts in a horizontal direction with respect to the ground and is positioned below the plurality of body parts.

Further, the robot may further include a partition driver that provides the partition rotation axis and rotate the partition about the partition rotation axis, and the partition may be extracted from the accommodation space when the partition driver rotates in one direction of a clockwise direction and a counterclockwise direction that is perpendicular to the first direction and may be retracted into the accommodation space when the partition driver rotates in the other one direction of the clockwise direction and the counterclockwise direction.

According to an embodiment of the present disclosure, a method of controlling a robot is provided wherein the robot can include a partition wound about a partition rotation axis extending in a first direction, a plurality of body parts surrounding an accommodation space in which the partition is accommodated, and a roller part having a plurality of rollers rotatably mounted on at least some of the plurality of body parts, the roller part includes a roller group that is a pair of rollers mounted to face each other in each of two adjacent body parts of the plurality of body parts, the roller part can be provided in a guide state in which movement of a portion of the partition is guided in a second direction intersecting the first direction when the portion of the partition is positioned between the pair of rollers, and the roller part provided in the guide state can extract the partition from the accommodation space or retracts the partition into the accommodation space in the second direction through rotation of the pair of rollers.

Further, the robot may be provided in plurality, and the method may include, when predetermined two robots among the plurality of robots are referred to a first robot and a second robot, an approaching operation of providing the first robot and the second robot that approach each other, an extraction operation of extracting a first partition from the first robot toward the second robot after the approaching operation, a retraction operation of retracting the first partition extracted from the first robot into the second robot, and a fixation operation of fixing the first partition retracted into the second robot to the second robot.

The method may further include an input operation of inputting a space partition request, and a movement operation of moving the first robot and the second robot away from each other in a state in which the first partition is fixed to the second robot based on the input space partition request.

BRIEF DESCRIPTION OF THE DRAWINGS

The above and other features and advantages of the present disclosure can be more apparent from the following detailed description taken in conjunction with the accompanying drawings, in which.

DETAILED DESCRIPTION OF ILLUSTRATIVE EMBODIMENTS

Figure 1:
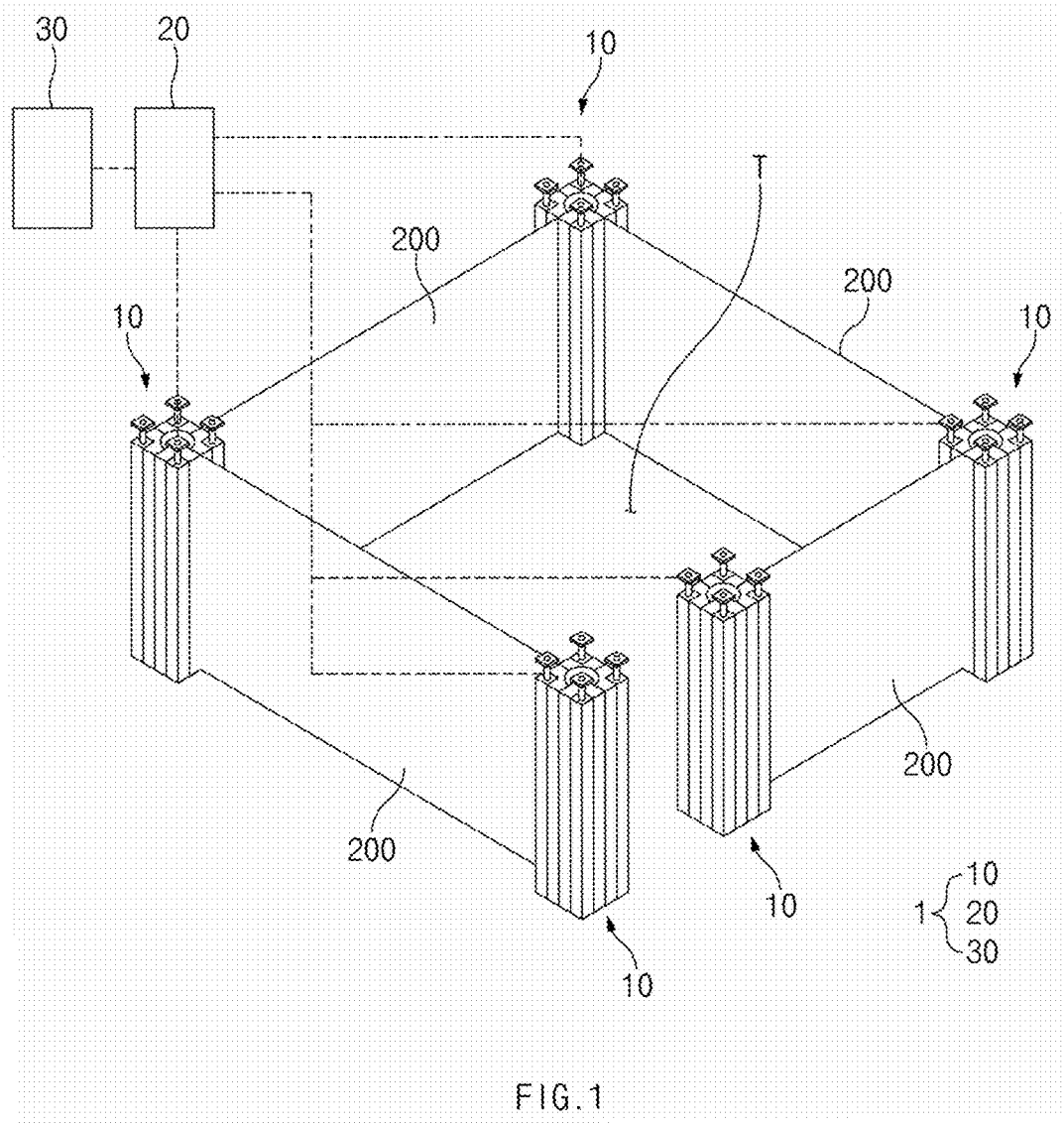
FIG. 1 is a perspective view of a space partitioning device according to an embodiment of the present disclosure.

Hereinafter, some example embodiments of the present disclosure will be described in detail with reference to the drawings. In adding reference numerals to components of each drawing, it can be noted that identical or equivalent components can be designated by an identical numeral even when they are displayed on other drawings. Further, in describing an example embodiment of the present disclosure, a detailed description of the related known configuration or function can be omitted when it is determined that it interferes with the understanding of the embodiment of the present disclosure.

Hereinafter, a space partitioning device 1 according to the embodiment of the present disclosure will be described with reference to the accompanying drawings.

Figure 2:
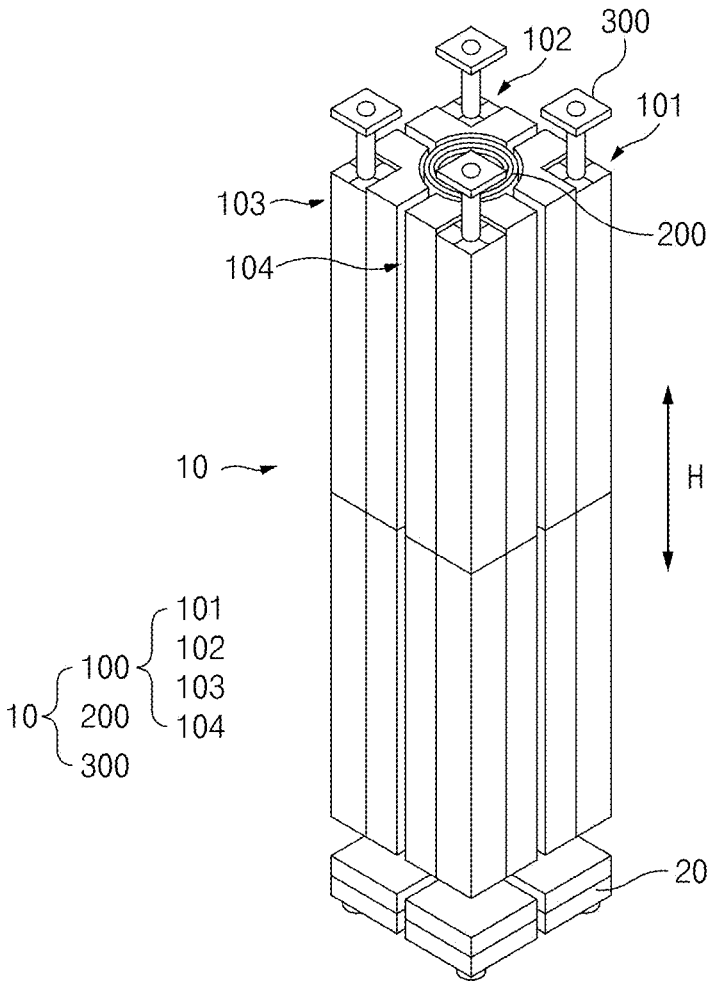
FIG. 2 is a perspective view of a robot according to an embodiment of the present disclosure.
Figure 3:
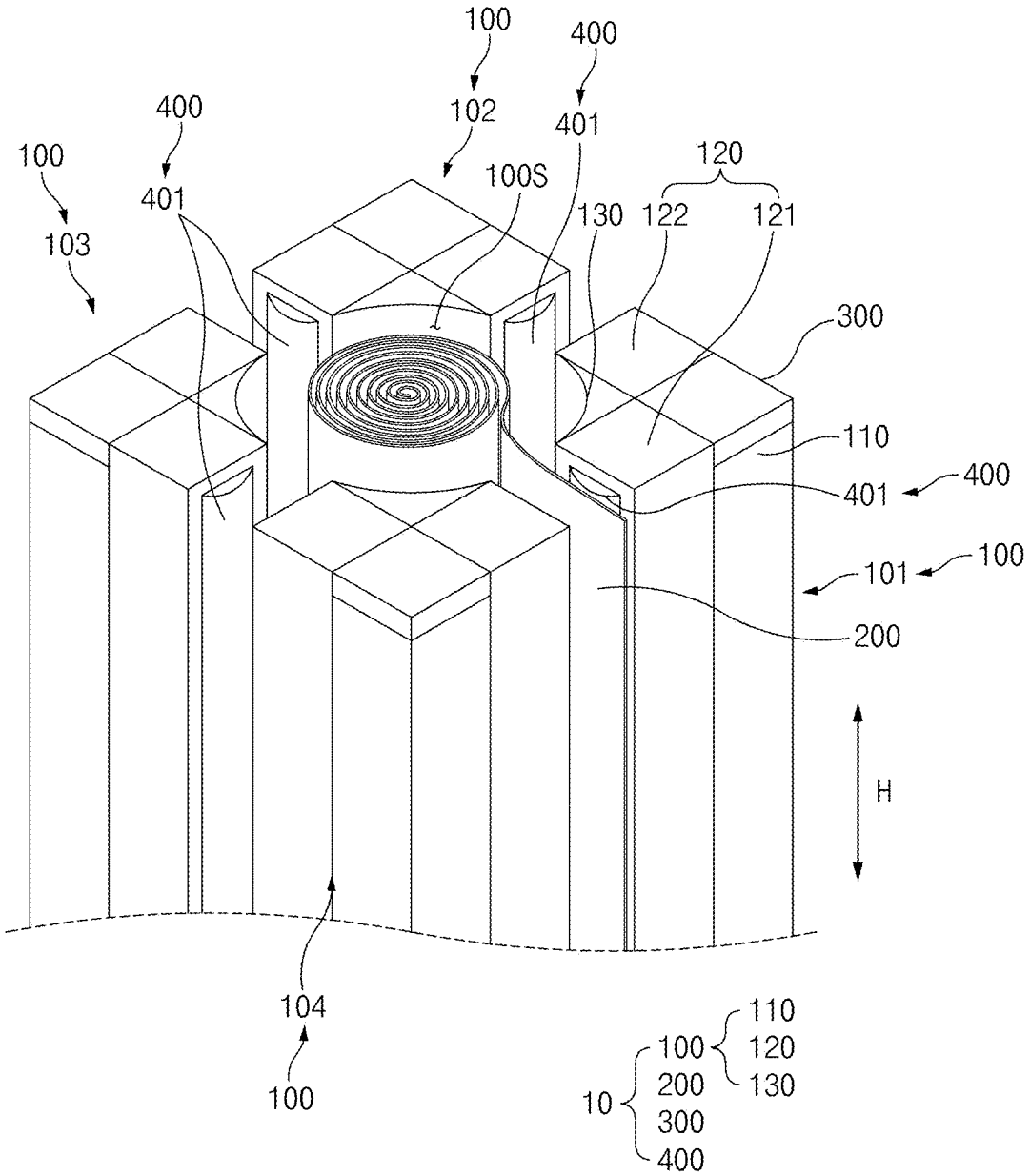
FIG. 3 is an enlarged perspective view illustrating a partial area of the robot according to an embodiment of the present disclosure.
Figure 4:
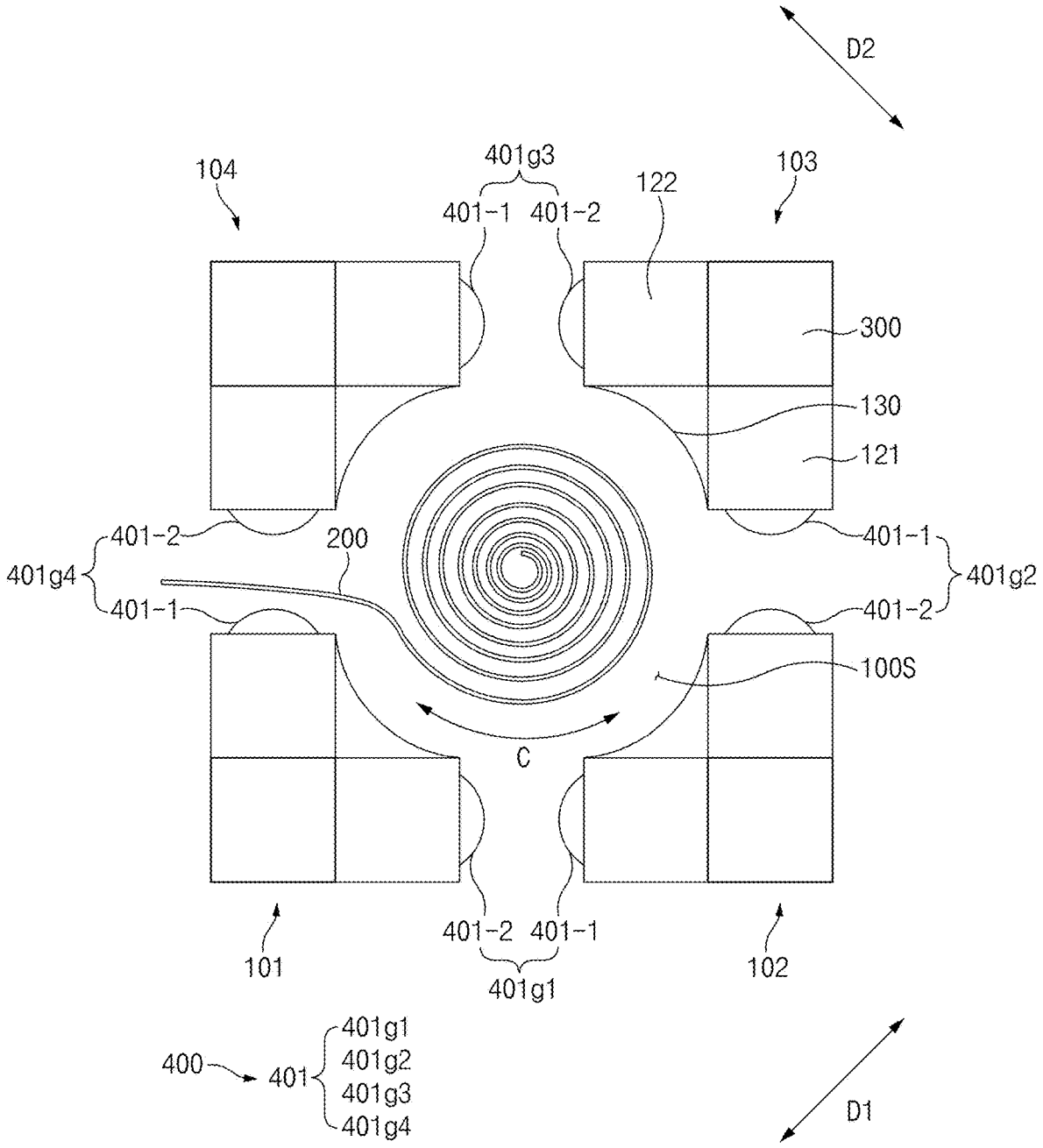
FIG. 4 is an enlarged plan view illustrating the partial area of the robot according to an embodiment of the present disclosure.

FIG. 1 is a perspective view of a space partitioning device according to an embodiment of the present disclosure. FIG. 2 is a perspective view of a robot according to an embodiment of the present disclosure. FIG. 3 is an enlarged perspective view illustrating a partial area of a robot according to an embodiment of the present disclosure. FIG. 4 is an enlarged plan view illustrating a partial area of a robot according to an embodiment of the present disclosure.

Referring to FIG. 1, the space partitioning device 1 may partition a predetermined space to form a target partitioning space "T" that is a target space. Further, when the position of the target partitioning space "T" changes, the space partitioning device 1 may form a changed target partitioning space in accordance with the changed position. The space partitioning device 1 may include a robot 10, a robot driver 20, and a controller 30.

Referring further to FIG. 2, the robot 10 may freely move on the ground by the robot driver 20. The robot 10 may be named a "space partitioning robot." The robot 10 may be provided as a plurality of robots 10. Each of the plurality of robots 10 may be moved to surround the set target partitioning space "T." For example, five robots 10 may be provided. The five robots 10 may be named a first robot, a second robot, a third robot, a fourth robot, and a fifth robot, respectively.

Referring back to FIG. 1, when the target partitioning space "T" has a rectangular parallelepiped shape, four robots 10 (e.g., the first robot, the second robot, the third robot, and the fourth robot) among the five robots 10 may be arranged at positions corresponding to vertical sides of the rectangular parallelepiped shape. As a detailed example, when viewed from the upper side of the target partitioning space "T," the target partitioning space "T" may have a rectangular shape, and the four robots 10 may be arranged at positions corresponding to the four corners of the rectangular shape.

Further, one robot 10 (e.g., the fifth robot) in addition to the four robots 10 may be placed to be positioned between two adjacent robots. For example, when the fifth robot is positioned between the first robot and the second robot adjacent to each other, the fifth robot may be connected to the first robot through a partition 200, which will be described below, and may be spaced apart from the second robot. For example, a separation space formed between the first robot and the fifth robot may be an entrance space which a user may enter and exit. The robot 10 may include a body part 100, the partition 200, a vertical moving part 300, and a roller part 400.

Referring further to FIGS. 3 and 4, the body part 100 may form an exterior of the robot 10. This body part 100 may extend in a vertical direction "H." The body part 100 may be provided as a plurality of body parts 100. The plurality of body parts 100 may be arranged to surround an accommodation space 100S in which the partition 200 is accommodated. For example, the accommodation space 100S may have a cylindrical shape. The plurality of body parts 100 may be arranged in a circumferential direction "C" of the accommodation space 100S. The circumferential direction "C" may include a clockwise direction and a counterclockwise direction perpendicular to the vertical direction. The clockwise direction and the counterclockwise direction may be defined based on a state in which an upper end of the robot 10 is viewed from below. The plurality of body parts 100 may include a first body part 101, a second body part 102, a third body part 103, and a fourth body part 104.

The first body part 101, the second body part 102, the third body part 103, and the fourth body part 104 may be sequentially arranged in the clockwise direction or the counterclockwise direction. Hereinafter, as illustrated in FIG. 4, a description is made based on a state in which the first body part 101, the second body part 102, the third body part 103, and the fourth body part 104 are sequentially arranged in the counterclockwise direction.

The first body part 101 and the third body part 103 may be spaced apart from each other in a first horizontal direction D1 with the partition 200 therebetween. The first body part 101 and the third body part 103 may pass through a center of the robot 10 and may be symmetrical to each other with respect to a first reference plane that is perpendicular to the first horizontal direction D1.

The second body part 102 and the fourth body part 104 may be spaced apart from each other in a second horizontal direction D2 with the partition 200 therebetween. The second body part 102 and the fourth body part 104 may pass through the center of the robot 10 and may be symmetrical to each other with respect to a second reference plane that is perpendicular to the second horizontal direction D2. Further, the first horizontal direction D1 and the second horizontal direction D2 may intersect each other. For example, the first horizontal direction D1 and the second horizontal direction D2 may be perpendicular to each other. Furthermore, the first horizontal direction D1 and the second horizontal direction D2 may be perpendicular to the vertical direction "H." Each of the plurality of body parts 100 may include a first area 110, a second area 120, and a third area 130.

The vertical moving part 300 may be mounted on the first area 110. An insertion groove into which a portion of the vertical moving part 300 may be inserted may be formed in the first area 110. The insertion groove may extend downward from an upper end of the first area 110. Further, an upper portion of the vertical moving part 300 may be seated on an upper surface of the first area 110.

The second area 120 may be connected to the first area 110. The second area 120 and the first area 110 may be arranged in a connection direction that is a direction in which the first area 110 faces the second area 120. The connection direction may be perpendicular to the vertical direction "H."

A roller 401, which will be described below, may be rotatably mounted in the second area 120. Further, a partial area of the roller 401, which will be described below, may be accommodated inside the second area 120. The second area 120 may be provided as a plurality of second areas 120. The plurality of second areas 120 may include a $(2\text{-}1)^{th}$ area 121 and a $(2\text{-}2)^{th}$ area 122.

The $(2\text{-}1)^{th}$ area 121 may be connected to one side of the first area 110. The $(2\text{-}1)^{th}$ area 121 and the first area 110 may be arranged in a first connection direction that is a direction in which the first area 110 faces the $(2\text{-}1)^{th}$ area 121.

The $(2\text{-}2)^{th}$ area 122 may be connected to the other side of the first area 110. The $(2\text{-}2)^{th}$ area 122 and the first area 110 may be arranged in a second connection direction that is a direction in which the first area 110 faces the $(2\text{-}2)^{th}$ area 122. The first connection direction, the second connection direction, and the vertical direction "H" may intersect each other. For example, the first connection direction, the second connection direction, and the vertical direction "H" may be perpendicular to each other.

The third area 130 may define a portion of an area that forms the accommodation space 100S. The third area 130 may be disposed between the $(2\text{-}1)^{th}$ area 121 and the $(2\text{-}2)^{th}$ area 122. The third area 130 may connect the $(2\text{-}1)^{th}$ area 121 and the $(2\text{-}2)^{th}$ area 122.

Further, a side of the third area 130 in a direction opposite to the second connection direction may be connected to the $(2\text{-}1)^{th}$ area 121. Further, a side of the third area 130 in a direction opposite to the first connection direction may be connected to the $(2\text{-}2)^{th}$ area 122. Further, as an example, the first area 110, the $(2\text{-}1)^{th}$ area 121, the $(2\text{-}2)^{th}$ area 122, and the third area 130 may be formed integrally. However, the present disclosure is not limited to this example, and the first area 110, the $(2\text{-}1)^{th}$ area 121, the $(2\text{-}2)^{th}$ area 122, and the third area 130 may be formed as separate members and may be separately coupled to each other.

Referring back to FIG. 4, the third area 130 may include a recessed area. The recessed area may have a shape recessed in a direction toward the first area 110. For example, a cross section of the recessed area in a direction (e.g., a horizontal direction) perpendicular to the vertical direction "H" may have a curvature such that the center of curvature is positioned in the accommodation space 100S. As a detailed example, the cross section of the recessed area in the direction (e.g., a horizontal direction) perpendicular to the vertical direction "H" may have an arc shape. Further, a cross section of the recessed area in the vertical direction "H" may have a straight line extending in the vertical direction "H" without curvature. The recessed area may be configured to face the partition 200 in a wound state.

Further, the centers of curvatures of the plurality of recessed areas provided in the plurality of body parts 100 (e.g., the first body part 101, the second body part 102, the third body part 103, and the fourth body part 104) may be formed at positions corresponding to each other. Further, the centers of curvatures of the recessed areas provided in the first body part 101, the second body part 102, the third body part 103, and the fourth body part 104 may correspond to the center of the robot 10 based on the horizontal direction.

A state in which predetermined components are formed at positions corresponding to each other may be understood as a concept including a state in which the predetermined components are formed exactly at the same position as well as a state in which the predetermined components are formed close to each other to the extent that the predetermined components exhibit the same effect as or the similar effect to the state in which the predetermined components are formed exactly at the same position.

The partition 200 may be wound about a partition rotation axis extending in a first direction. The first direction may mean the vertical direction "H." This partition 200 may be named a "rollable partition."

Further, the partition 200 may be accommodated in the accommodation space 100S. A portion of the partition 200 may be extracted from the accommodation space 100S to the outside of the robot 10. Further, a portion of the partition 200 positioned outside the robot 10 may be retracted into the accommodation space 100S.

The partition 200 may be made of a flexible material. The partition 200 may be used to partition a space as well as used as a display that displays an image.

Referring back to FIG. 2, the vertical moving part 300 may move in the vertical direction "H" with respect to the body part 100. The vertical moving part 300 may be movably inserted into the first area 110. The vertical moving part 300 may be extracted upward from the body part 100 and may be in close contact with a portion (e.g., a ceiling or the like) that closes an upper portion of a space on which the robot 10 is seated. The robot 10 that reaches a target position may be stably fixed in place through the vertical moving part 300.

The vertical moving part 300 may include an upper plate and a pillar part. The upper plate may form the upper portion of the vertical moving part 300. A lower surface of the upper plate may be in close contact with the upper surface of the first area 110. For example, when the vertical moving part 300 is positioned at the lowermost side (when the vertical moving part 300 is lowered to the maximum with respect to the body part 100), the lower surface of the upper plate may be in contact with the upper surface of the first area 110.

Referring back to FIG. 3, when the vertical moving part 300 is positioned at the lowermost side, a height of an upper end of the upper plate in the vertical direction "H" and a height of an upper end of the body part 100 in the vertical direction "H" may correspond to each other. In other words, when the vertical moving part 300 is positioned at the lowermost side, a height of an upper end of the vertical moving part 300 in the vertical direction "H" and a height of the upper end of the body part 100 in the vertical direction "H" may correspond to each other.

In this way, when the vertical moving part 300 is positioned at the lowermost side, the height of the upper end of the vertical moving part 300 and the height of the upper end of the body part 100 correspond to each other. Thus, the vertical moving part 300 that is not extracted upward and the first area 110 may be prevented from forming a sense of difference in a design with the second area 120 and the third area 130.

The pillar part may have a shape extending downward from a lower end of the upper plate. For example, the pillar part and the upper plate may be formed integrally. The pillar part may be inserted into the insertion groove of the first area 110. For example, the pillar part may be inserted downward into the insertion groove or may be released upward from the insertion groove. The upper plate may move downward relative to the body part 100 by the insertion operation of the pillar part and the upper plate may move upward relative to the body part 100 by the releasing operation of the pillar part.

The roller part 400 may include a plurality of rollers 401. The roller 401 may rotate about a rotation axis extending in the vertical direction "H." The roller 401 may be rotatably mounted on the body part 100. For example, the roller 401 may be rotatably mounted in the second area 120. As a detailed example, the roller 401 may include a first roller 401-1 and a second roller 401-2 that are mounted on the $(2\text{-}1)^{th}$ area 121 and the $(2\text{-}2)^{th}$ area 122, respectively.

The first roller 401-1 may be mounted on a side of the $(2\text{-}1)^{th}$ area 121 in the first connection direction. For example, a side of the first roller 401-1 in the first connection direction may protrude in the first connection direction with respect to the $(2\text{-}1)^{th}$ area 121. In other words, a portion of the first roller 401-1 in a direction opposite to the first connection direction may be accommodated inside the $(2\text{-}1)^{th}$ area 121.

The second roller 401-2 may be mounted on a side of the $(2\text{-}2)^{th}$ area 122 in the second connection direction. For example, a side of the second roller 401-2 in the second connection direction may protrude in the second connection direction with respect to the $(2\text{-}2)^{th}$ area 122. In other words, a portion of the second roller 401-2 in a direction opposite to the second connection direction may be accommodated inside the $(2\text{-}2)^{th}$ area 122.

The plurality of rollers 401 may include a roller group. The roller group may be a pair of rollers mounted to face each other in two adjacent body parts 100 of the plurality of body parts 100. As an example, the two adjacent body parts of the plurality of body parts 100 may be the first body part 101 and the second body part 102, the second body part 102 and the third body part 103, the third body part 103 and the fourth body part 104, or the fourth body part 104 and the first body part 101.

When the portion of the partition 200 is located between the pair of rollers, the roller part 400 may be provided in a guide state in which movement of the portion of the partition 200 is guided in a second direction that is a direction intersecting the first direction (e.g., the vertical direction "H"). The second direction may include the first connection direction, the second connection direction, a direction opposite to the first connection direction, and a direction opposite to the second connection direction.

Further, the roller part 400 provided in the guide state may extract the partition 200 from the accommodation space 100S in the second direction or may retract the partition 200 into the accommodation space 100S in the second direction through rotation of the pair of rollers 401. For example, when the roller part 400 is in the guide state, the pair of rollers 401 may rotate while gripping the portion of the partition 200 and move the portion of the partition 200 in the second direction. In other words, the portion of the partition 200 may move in the second direction by a rotational force of the pair of rollers 401. In this case, for example, the partition 200 may be provided with a spiral spring such that the partition 200 is retracted into and wound on the accommodation space 100S.

However, the present disclosure is not necessarily limited to this example, and when the roller part 400 is in the guide state, the partition 200 may be prevented from being separated from a direction skewed from the second direction by the pair of rollers 401. For example, when the roller part 400 is in the guide state, the partition 200 may move in the second direction to pass through a space between the pair of rollers 401 by a partition driver (not illustrated). The partition driver may be a component provided in the robot 10. For example, the partition driver may be a motor that provides a partition rotation axis and winds the partition 200 about the partition rotation axis. For example, when the partition driver rotates in one direction among the clockwise direction and the counterclockwise direction, the partition 200 may be extracted from the accommodation space 100S, and when the partition driver rotates in the other one direction among the clockwise direction and the counterclockwise direction, the partition 200 may be retracted into the accommodation space 100S.

Referring back to FIG. 4, the roller group may be provided as a plurality of roller groups. The plurality of roller groups may include a first roller group 401*g*1, a second roller group 401*g*2, a third roller group 401*g*3, and a fourth roller group 401*g*4.

The first roller group 401*g*1 may be a pair of rollers mounted to face each other in the first body part 101 and the second body part 102. For example, the pair of rollers of the first roller group 401*g*1 may be provided with the second roller 401-2 mounted on the first body part 101 and the first roller 401-1 mounted on the second body part 102.

The second roller group 401*g*2 may be a pair of rollers mounted to face each other in the second body part 102 and the third body part 103. For example, the pair of rollers of the second roller group 401*g*2 may be provided with the second roller 401-2 mounted on the second body part 102 and a first roller 401-1 mounted on the third body part 103.

The third roller group 401*g*3 may be a pair of rollers mounted to face each other in the third body part 103 and the fourth body part 104. For example, the pair of rollers of the third roller group 401*g*3 may be provided with the second roller 401-2 mounted on the third body part 103 and the first roller 401-1 mounted on the fourth body part 104.

The fourth roller group 401*g*4 may be a pair of rollers mounted to face each other in the fourth body part 104 and the first body part 101. For example, the pair of rollers of the fourth roller group 401*g*4 may be provided with the second roller 401-2 mounted on the fourth body part 104 and the first roller 401-1 mounted on the first body part 101. The first roller group 401*g*1, the second roller group 401*g*2, the third roller group 401*g*3, and the fourth roller group 401*g*4 may be sequentially arranged in the clockwise direction or the counterclockwise direction.

Further, in one of the plurality of roller groups, the partition 200 may be extracted, and in the others of the plurality of roller groups, a portion of the partition 200 positioned outside the robot 10 may be gripped. For example, in the first roller group 401*g*1 of a first robot, the partition 200 of the first robot may be extracted, and in at least one of the second roller group 401*g*2, the third roller group 401*g*3, and the fourth roller group 401*g*4 provided in the first robot, a portion of the partition 200 extracted by a second robot may be gripped.

The robot driver 20 may move the robot 10 relative to the ground. The robot driver 20 may be mounted on a lower portion of the robot 10. The robot driver 20 may be a component included in the robot 10. In other words, the robot driver 20 may form a portion of the robot 10. Further, the robot driver 20 may rotate the plurality of rollers 401 independently.

The robot driver 20 may be provided as a plurality of robot drivers 20. The plurality of robot drivers 20 may be provided to correspond to the plurality of robots 10, respectively.

Figure 5:
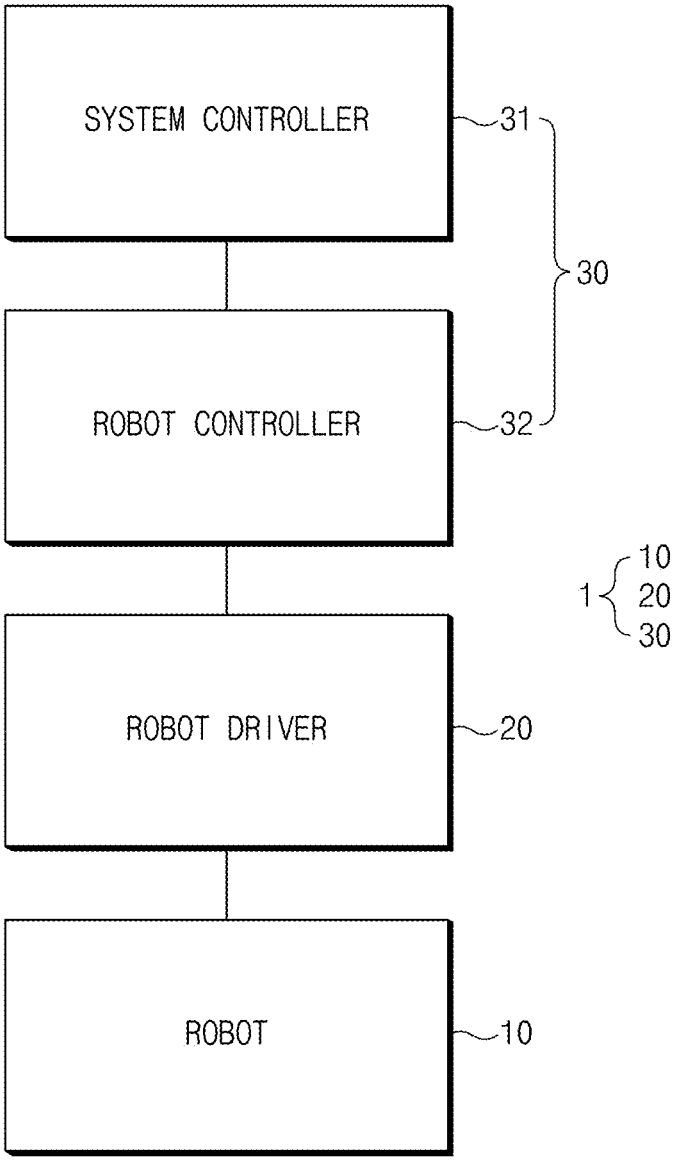
FIG. 5 is a block diagram illustrating the space partitioning device according to an embodiment of the present disclosure.

FIG. 5 is a block diagram illustrating the space partitioning device according to an embodiment of the present disclosure.

Referring further to FIG. 5, the controller 30 may control the plurality of robots 10 and the plurality of robot drivers 20. The controller 30 may include a system controller 31 and a robot controller 32.

A space partition request may be input to the system controller 31 (input operation S100). The system controller 31 may classify the plurality of robots 10 through numbering, based on the space partition request. For example, when the number of the plurality of robots 10 is five, the five robots 10 may be classified into the first robot, the second robot, the third robot, the fourth robot, and the fifth robot.

The system controller 31 may determine positions of the plurality of robots 10 and then set target positions. The system controller 31 may transmit, to the robot controller 32, a signal related to current position information and target position information of the plurality of robots 10.

The robot controller 32 may control the robot driver 20 so that the plurality of robots 10 move, based on the current position information and the target position information. The robot controller 32 may control the robot driver 20 so that the plurality of robots 10 approach each other (approaching operation S200). Further, in a state in which the plurality of robots 10 approach each other, the robot controller 32 may control the extraction, the retraction, and the fixation of the partition 200 in the plurality of robots 10.

Hereinafter, a process of forming the target partitioning space "T" when four robots 10 are provided will be described in detail.

The robot controller 32 may control the robot driver 20 so that the four robots are in close contact with each other and arranged in a 2×2 matrix (based on a state in which the space partitioning device 1 is viewed from above).

Figure 6:
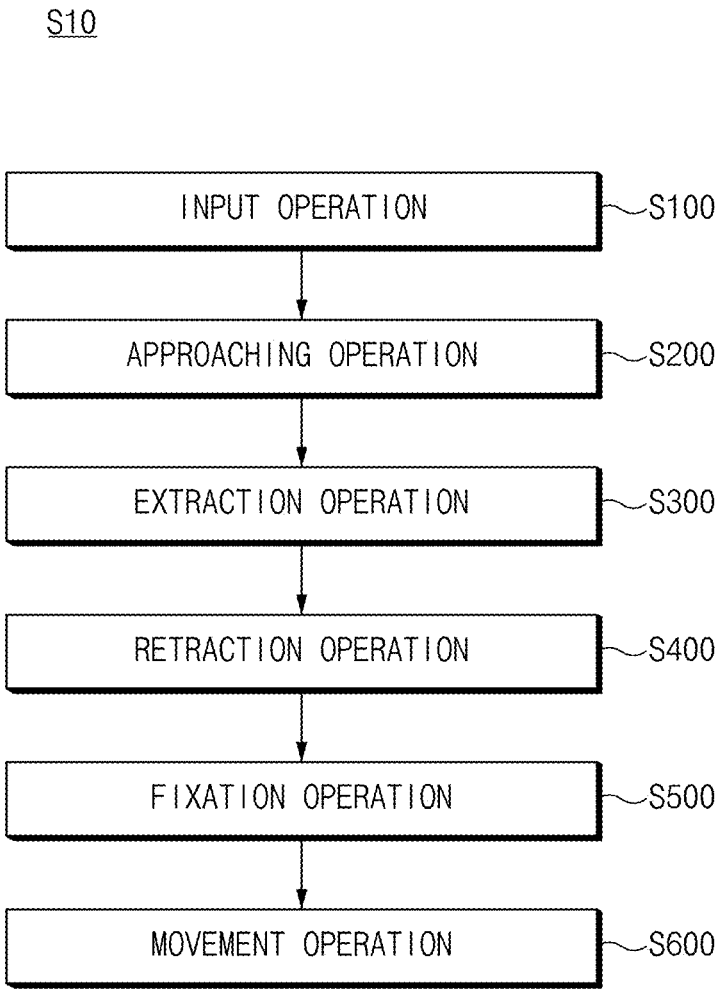
FIG. 6 is a schematic flowchart illustrating a method of controlling the robot according to an embodiment of the present disclosure.

FIG. 6 is a schematic flowchart illustrating a method of controlling a robot according to an embodiment of the present disclosure.

Referring further to FIG. 6, the robot positioned at a first row and a first column may extract the partition toward the robot positioned at the first row and a second column (extraction operation S300). The partition of the robot positioned at the first row and the first column may be retracted into the roller group of the robot positioned at the first row and the second column (retraction operation S400). The robot positioned at the first row and the second column may grip and fix the partition of the robot positioned at the first row and the first column (fixation operation S500).

Further, the robot positioned at the first row and the second column may extract the partition toward the robot positioned at a second row and the second column (extraction operation S300). The partition of the robot positioned at the first row and the second column may be retracted into the roller group of the robot positioned at the second row and the second column (retraction operation S400). The robot positioned at the second row and the first column may grip and fix the partition of the robot positioned at the first row and the second column (fixation operation S500).

Further, the robot positioned at the second row and the second column may extract the partition toward the robot positioned at the second row and the first column (extraction operation S300). The partition of the robot positioned at the second row and the second column may be retracted into the roller group of the robot positioned at the second row and the first column (retraction operation S400). The robot positioned at the second row and the first column may grip and fix the partition of the robot positioned at the second row and the second column (fixation operation S500).

Further, the robot positioned at the second row and the first column may extract the partition toward the robot positioned at the first row and the first column (extraction operation S300). The partition of the robot positioned at the second row and the first column may be retracted into the roller group of the robot positioned at the first row and the first column (retraction operation S400). The robot positioned at the first row and the first column may grip and fix the partition of the robot positioned at the second row and the second column (fixation operation S500).

Thereafter, the robot controller 32 may control the robot driver 20 so that the four robots move away from each other while fixing the partitions of the adjacent robots to form the target partitioning space "T" (movement operation S600).

The system controller 31 and the robot controller 32 may be electrically connected to the plurality of robots 10 and the plurality of robot drivers 20 and may be implemented by a process having a function of decoding and executing commands based on previously input information.

Hereinafter, a method S10 of controlling the robot will be described with reference to FIG. 6.

The method S10 of controlling a robot may include input operation S100, approaching operation S200, extraction operation S300, retraction operation S400, fixation operation S500, and movement operation S600.

In input operation S100, the space partition request may be input. The space partition request may include information on the target partitioning space "T."

In approaching operation S200, the first robot and the second robot that are two predetermined robots among the plurality of robots 10 may approach each other to become closer to each other. As an example, approaching operation S200 may be performed after input operation S100.

In extraction operation S300, the partition may be extracted from one to the other one of the first robot and the second robot. For example, in extraction operation S300, a first partition that is a partition of the first robot may be extracted toward the second robot. As an example, extraction operation S300 may be performed after approaching operation S200.

In retraction operation S400, the partition may be retracted from one to the other one of the first robot and the second robot. For example, in retraction operation S400, the first partition may be retracted between the pair of rollers provided in the roller group of the second robot (the roller group closest to the first robot among the plurality of roller groups).

As an example, retraction operation S400 may be performed simultaneously with extraction operation S300. For example, a partition of one robot among the plurality of robots 10 may be extracted from the one robot, and at the same time, a partition extracted from another robot may be retracted into the one robot.

In fixation operation S500, the partition retracted into any one of the first robot and the second robot may be fixed. For example, the first partition retracted into the second robot may be gripped and fixed by the pair of rollers provided in the roller group of the second robot. As an example, fixation operation S500 may be performed after retraction operation S400.

In movement operation S600, the plurality of robots 10 may move away from each other while one robot fixes a partition of another robot, to form the target partitioning space "T." Further, in movement operation S600, after the target partitioning space "T" is formed, the vertical moving part 300 may move upward and come into close contact with the ceiling. As an example, movement operation S600 may be performed after fixation operation S500.

A robot according to an embodiment of the present disclosure may flexibly respond to changes of positions of spaces that require partitioning.

Hereinabove, even though it has been described that all components constituting the embodiments of the present disclosure are combined into one part or are operated while combined with each other, the present disclosure is not necessarily limited to these embodiments. That is, all the components may be operated while selectively combined into one or more parts within the scope of the present disclosure. Further, terms such as "includes", "constitutes", or "have" described above can mean that the corresponding component may be inherent unless otherwise stated, and thus can be construed as not excluding other components but further including other components. Terms including technical or scientific terms can have same meanings as those commonly understood by those skilled in the art to which the present disclosure pertains unless otherwise defined. Generally used terms defined in the dictionaries can be construed as having meanings that coincide with meanings of the contexts of the related technologies, and/or can be clearly defined in the present disclosure.

The above description is merely illustrative of the technical spirit of the present disclosure, and those skilled in the art to which the present disclosure belongs may make various modifications and changes without departing from features of the present disclosure. Thus, the example embodiments disclosed in the present disclosure are not intended to necessarily limit the technology spirit of the present disclosure, but are intended to describe the present disclosure, and scopes of the technical spirit of the present disclosure are not necessarily limited by these example embodiments. The scopes of protection of the present disclosure can be interpreted by the appended claims, and all technical spirits within scopes equivalent thereto can be interpreted as being included in scopes of the present disclosure.

What is claimed is:

1. A robot comprising:

a partition wound about a partition rotation axis extending in a first direction;

a plurality of body parts surrounding an accommodation space in which the partition is accommodated; and a roller part having rollers rotatably mounted on at least some of the plurality of body parts, wherein the roller part includes a roller group that is a pair of the rollers mounted to face each other in each of two adjacent body parts of the plurality of body parts, wherein the roller part is configured to provide a guide state in which movement of a portion of the partition is guided in a second direction intersecting the first direction while the portion of the partition is located between the pair of the rollers, and wherein the roller part is configured to extract the partition from the accommodation space or retract the partition into the accommodation space in the second direction through rotation of the pair of the rollers.

2. The robot of claim 1, further comprising a vertical moving part configured to move in a vertical direction parallel to the first direction with respect to a given body part of the plurality of body parts, wherein the given body part includes a first area on which the vertical moving part is movably mounted such that a portion of the vertical moving part is accommodated therein.

3. The robot of claim 2, wherein, with the vertical moving part at a lowermost side with respect to the given body part, an upper end of the vertical moving part and the given body part have a same height location in the vertical direction.

4. The robot of claim 2, wherein the given body part includes a second area connected to the first area and on which a given roller of the rollers is rotatably mounted such that a first partial area of the given roller is accommodated therein, and wherein a second partial area of the given roller protrudes in a connection direction with respect to the second area.

5. The robot of claim 4, wherein the second area includes:

a first-second area connected to a first side of the first area; and a second-second area connected to a second side of the first area, wherein the first side of the first area faces the first-second area in a first connection direction, wherein the second side of the first area faces the second-second area in a second connection direction, and wherein the first connection direction intersects the second connection direction.

6. The robot of claim 5, wherein the pair of the rollers includes:

a first roller mounted on the first-second area; and a second roller mounted on the second-second area, wherein a first-roller portion of the first roller opposite to the first connection direction is accommodated inside the first-second area such that a first-roller side of the first roller protrudes in the first connection direction with respect to the first-second area, and wherein a second-roller portion of the second roller opposite to the second connection direction is accommodated inside the second-second area such that a second-roller side of the second roller protrudes in the second connection direction with respect to the second-second area.

7. The robot of claim 2, wherein the given body part further includes a third area configured to define an accommodation-space portion of the accommodation space and extending in the first direction, and wherein the third area includes a recessed area provided to face the partition in a wound state and having a shape recessed in a direction toward the first area.

8. The robot of claim 7, wherein a cross section of the recessed area perpendicular to the first direction has a curvature of which a center of the curvature is positioned in the accommodation space.

9. The robot of claim 2, wherein each of the plurality of body parts includes a third area configured to define an accommodation-space portion of the accommodation space and extending in the first direction, and wherein the third area includes a recessed area provided to face the partition in a wound state and having a shape recessed in a direction toward the first area, wherein each center of curvature of a cross section of the recessed area provided in the plurality of body parts correspond to each other.

10. The robot of claim 1, wherein the plurality of body parts include a first body part, a second body part, a third body part, and a fourth body part that are sequentially arranged in a clockwise direction or a counterclockwise direction perpendicular to the first direction, wherein the roller group includes:

a first roller group that is a first pair of the rollers mounted to face each other in the first body part and the second body part;

a second roller group that is a second pair of the rollers mounted to face each other in the second body part and the third body part;

a third roller group that is a third pair of the rollers mounted to face each other in the third body part and the fourth body part; and a fourth roller group that is a fourth pair of the rollers mounted to face each other in the fourth body part and the first body part, and wherein the first roller group, the second roller group, the third roller group, and the fourth roller group are sequentially arranged in the clockwise direction or the counterclockwise direction.

11. The robot of claim 10, wherein a first horizontal direction is perpendicular to the first direction, wherein a second horizontal direction is perpendicular to the first horizontal direction, wherein the first body part and the third body part are spaced apart from each other in the first horizontal direction with the partition interposed between the first body part and the third body part, and wherein the second body part and the fourth body part are spaced apart from each other in the second horizontal direction with the partition interposed between the second body part and the fourth body part.

12. The robot of claim 1, further comprising a robot driver configured to move the plurality of body parts in a horizontal direction with respect to ground and positioned below the plurality of body parts.

13. The robot of claim 1, further comprising a partition driver configured to:

provide the partition rotation axis;

rotate the partition about the partition rotation axis;

extract the partition from the accommodation space in response to the partition driver rotating in a first rotation direction; and retract the partition into the accommodation space in response to the partition driver rotating in a second rotation direction.

14. A method of controlling a first robot and a second robot, wherein each of the first robot and the second robot includes:

a partition wound about a partition rotation axis extending in a first direction, a plurality of body parts surrounding an accommodation space in which the partition is accommodated, and a roller part having rollers rotatably mounted on at least some of the plurality of body parts, wherein the roller part includes a roller group that is a pair of the rollers mounted to face each other in each of two adjacent body parts of the plurality of body parts, wherein the roller part is configured to provide a guide state in which movement of a portion of the partition is guided in a second direction intersecting the first direction while the portion of the partition is located between the pair of the rollers, and wherein the roller part is configured to extract the partition from the accommodation space or retract the partition into the accommodation space in the second direction through rotation of the pair of the rollers;

wherein the method comprises:

approaching the first robot and the second robot to each other;

extracting a first partition from the first robot toward the second robot after the approaching;

retracting the first partition extracted from the first robot into the second robot; and fixing the first partition retracted into the second robot to the second robot.

15. The method of claim 14, further comprising:

inputting a space partition request; and moving the first robot and the second robot away from each other in a state in which the first partition is fixed to the second robot based on the inputting of the space partition request.

16. A robot comprising:

a partition wound about a partition rotation axis extending in a first direction;

a plurality of body parts surrounding an accommodation space in which the partition is accommodated;

a roller part having rollers rotatably mounted on at least some of the plurality of body parts, wherein the roller part includes a roller group that is a pair of the rollers mounted to face each other in each of two adjacent body parts of the plurality of body parts, and wherein the roller part is configured to guide movement of a portion of the partition in a second direction intersecting the first direction while the portion of the partition is located between the pair of the rollers; and a robot driver configured to move the plurality of body parts in a horizontal direction with respect to ground and positioned below the plurality of body parts.

17. The robot of claim 16, further comprising a partition driver configured to:

provide the partition rotation axis;

rotate the partition about the partition rotation axis;

extract the partition from the accommodation space in response to the partition driver rotating in a first rotation direction; and retract the partition into the accommodation space in response to the partition driver rotating in a second rotation direction.

18. The robot of claim 17, wherein the roller part is configured to extract the partition from the accommodation space or retract the partition into the accommodation space in the second direction through rotation of the pair of the rollers.

19. The robot of claim 16, further comprising a vertical moving part configured to move in a vertical direction parallel to the first direction with respect to a given body part of the plurality of body parts, wherein the given body part includes a first area on which the vertical moving part is movably mounted such that a portion of the vertical moving part is accommodated therein.

20. The robot of claim 16, wherein a given body part further includes a third area configured to define an accommodation-space portion of the accommodation space and extending in the first direction, and wherein the third area includes a recessed area provided to face the partition in a wound state and having a recessed shape, wherein a cross section of the recessed area perpendicular to the first direction has a curvature of which a center of the curvature is positioned in the accommodation space.

* * * * *